United States Patent [19]

Pronovost et al.

[11] Patent Number: 4,505,127

[45] Date of Patent: Mar. 19, 1985

[54] METHOD AND APPARATUS FOR TREATING NATURAL GAS FROM GAS WELLS FOR SAFE TRANSPORTATION IN PRESSURE VESSELS

[75] Inventors: Richard Pronovost, Ste-Julie; Peter Innis, Brossard; Léo M. O'Rourke, Olds, all of Canada

[73] Assignee: SOQUIP, Canada

[21] Appl. No.: 467,454

[22] Filed: Feb. 17, 1983

[30] Foreign Application Priority Data

Apr. 28, 1982 [CA] Canada ..... 401826

[51] Int. Cl.[3] ..... F25D 23/00

[52] U.S. Cl. ..... 62/271; 48/191; 62/94

[58] Field of Search ..... 62/11, 17, 54, 93, 94, 62/86; 48/190, 191

[56] References Cited

U.S. PATENT DOCUMENTS

| | | | |
|---|---|---|---|
| 2,077,315 | 4/1937 | Ewing et al. | 62/93 |
| 3,091,097 | 5/1963 | Friant | 62/93 |
| 3,226,948 | 1/1966 | Alderson et al. | 62/93 |
| 3,587,243 | 6/1971 | Keller | 62/93 |
| 3,854,300 | 12/1974 | Gerhold | 62/93 |

*Primary Examiner*—Ronald C. Capossela
*Attorney, Agent, or Firm*—Oblon, Fisher, Spivak, McClelland & Maier

[57] ABSTRACT

A system for treating natural gas from a gas source, such as a gas well, to make it suitable for safe transport in high tensile strength pressure vessels at pressures in excess of 2000 psi. The system comprises suitable pipes and valves for taking gas from a gas well. A separator is provided for removing free liquids from the gas fed thereto from the gas well to provide a substantially liquid-free gas. A compressor compresses the substantially liquid-free gas to a higher pressure to reduce the volume of the gas for storage in the pressure vessels. A cooler is further provided to reduce the volume of gas and to recondition the gas for dehydration. A dehydrator substantially lowers the water vapor content in the gas to a concentration of less than 0.1 lb $H_2O$/mmscf of gas to prevent the formation of free water within the pressure vessels when transporting and unloading the gas and which water would cause internal corrosion and failure of the pressure vessels. Pipes and valves are also provided for loading the pressurized dehydrated gas in the vessels.

17 Claims, 4 Drawing Figures

METHOD AND APPARATUS FOR TREATING NATURAL GAS FROM GAS WELLS FOR SAFE TRANSPORTATION IN PRESSURE VESSELS

BACKGROUND OF THE INVENTION (a) Field of the Invention

The present invention relates to a system for treating natural gas from a gas source to make it suitable for safe transport in high tensile strength steel pressure vessels at pressures in excess of 2000 psi and to unload the natural gas at a remote user facility in a system capable of feeding a constant supply of pressurized gas to the user.

(b) Description of Prior Art

The transportation of natural gas by transport vehicle has been known for many years in countries such as Italy and France. Also, it has long been known in Italy, for example, to utilize compressed natural gas to operate vehicles. Thus, natural gas is taken from a gas well and pressurized to a high pressure (in the order of 250 bars) and transported in vessels mounted on a vehicle whereby to distribute the pressurized gas to small gas distribution stations where the gas is unloaded and stored in high pressure containers to later be discharged in the pressure vessels of vehicles. Such a system is described in a publication entitled "Manuel pour le Transport et la Distribution du Gaz" published in 1968 by the Société du Journal des Usines à Gaz, 62, rue de Courcelles, Paris (VIII), which publication is put out by the Technical Association of the Gas Industry of France.

Canadian Pat. No. 1,073,399 issued Mar. 11, 1980 describes a method and system for transporting well known principles as described in the above-mentioned French publication and was developed primarily for the collection and transport of gas from gas wells where it is uneconomical to build a feeder pipe line and particularly where the wells were low-producing, isolated or located in remote places. The advent of high energy costs has brought about the feasibility of transporting compressed natural gas by vehicle. However, it has been found that in order to safely handle natural gas at the loading station (where the gas wells are located) during transportation by road vehicles, and at a discharge station, various problems were required to be solved. A major problem in handling natural gas is the formation of hydrates in the gas which results when the gas undergoes cooling, such as in underground pipe lines. A hydrate is a clathrate chemical combination of water in the liquid phase and light hydrocarbon molecules in the form of a crystal. The necessary water for hydrate production is present in all hydrocarbon reservoirs and may reach the surfaces either as produced or condensed water. Produced water flows in the reservoir and enters the well bore in liquid form. Condensed water is in the vapor phase at reservoir conditions that condenses out at the reduced temperatures achieved through expansion of the gas to low pressure and/or heat exchange at the surface of the well. The condensation of the water into the liquid form presents a problem to the vessels of transport vehicles since these vessels are constructed of high tensile strength steel which is susceptible to corrosion and subsequent failure.

When a gas loading facility is located in the vicinity of two or more gas wells, it is also necessary to ensure the safe delivery of the gas from the gas well to the loading facility, particularly when one of the wells is connected to the facility by approximately a one-mile pipe line. Another disadvantage which arises when transporting natural gas by road vehicles is that a constant supply of gas at an unloading station must be ensured, particularly when that unloading station is feeding a user which cannot shut-down. Due to inclement weather conditions, vehicle break-downs or slow-downs frequently occur and there is thus a need to provide an unloading station having a capability that will ensure continuous supply of gas.

SUMMARY OF THE INVENTION

It is a feature of the present invention to provide an improved system for treating natural gas from a gas well to make it suitable for safe transport in pressure vessels at pressures in excess of 2000 psi and for feeding a constant supply of pressurized gas to a gas user, and which substantially overcomes all of the above-mentioned disadvantages.

A further feature of the present invention is to provide an improved system for treating natural gas from a gas source, such as a gas well, and capable of lowering the water vapor content in the gas to a concentration of less than 0.1 lb $H_2O$/mmscf of gas.

According to the above features of the present invention, from a broad aspect, the present invention provides a system for treating natural gas from a gas source to make it suitable for safe transport in high tensile strength steel pressure vessels at pressures in excess of 2000 psi. The system comprises means for taking gas from a gas source. The separator removes free liquids from the gas fed thereto from the gas source to provide a substantially liquid-free gas. A compressor compresses the substantially liquid-free gas to a higher pressure to reduce the volume of the gas for storage in pressure vessels. A cooler further reduces the volume of gas and reconditions the gas for dehydration. A dehydrator substantially lowers the water vapor content of the gas to a concentration of less than 0.1 lb of $H_2O$/mmscf of gas to prevent the formation of free water within the pressure vessels when transporting and unloading the gas, which water would cause internal corrosion and failure of the pressure vessels. Loading means is provided to load the pressurized dehydrated gas in the vessels.

According to a further broad aspect of the present invention, the system also provides for the feeding of a constant supply of pressurized gas to a gas user. Unloading means is provided to unload the pressurized dehydrated gas from the pressure vessels. A heater is provided for heating the discharged gas from the vessels to maintain the temperature above critical temperature for steel embrittlement. Pressure regulating means is provided to maintain the discharged gas at a constant line pressure in excess of 18 psi. A stand-by supply system is provided for feeding a propane/air mixture to the user when the natural gas system alone cannot maintain an adequate energy supply to the customer.

According to a further broad aspect of the present invention, the concentration of the water vapor content in the gas is maintained substantially less than 0.1 lb of $H_2O$/mmscf of gas.

BRIEF DESCRIPTION OF DRAWINGS

A preferred embodiment of the present invention will now be described with reference to the accompanying drawings, in which.

DESCRIPTION OF PREFERRED EMBODIMENTS

Figure 1A:
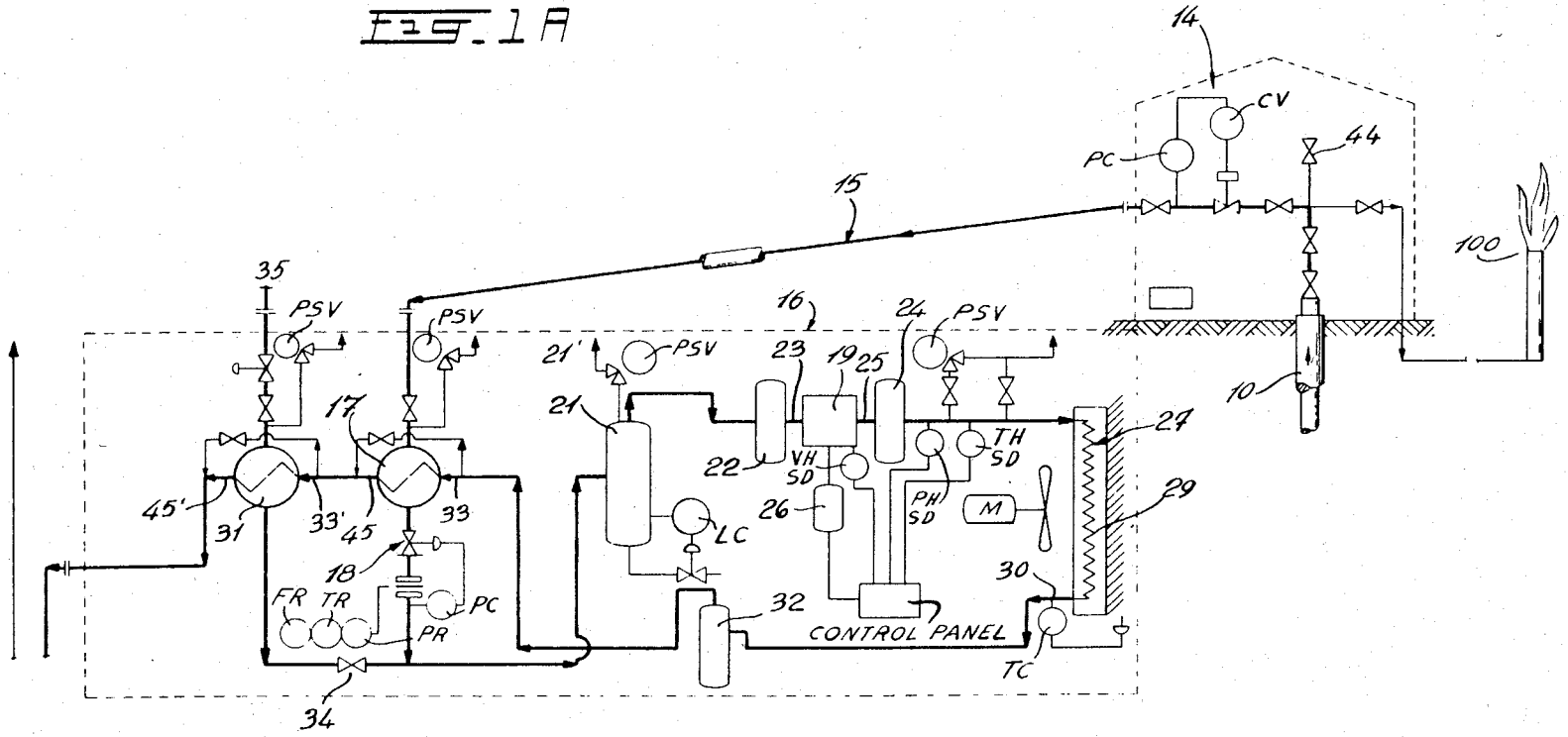
FIGS. 1A, 1B and 1C are a schematic flow diagram of the loading station of the system of the present invention.
Figure 1B:
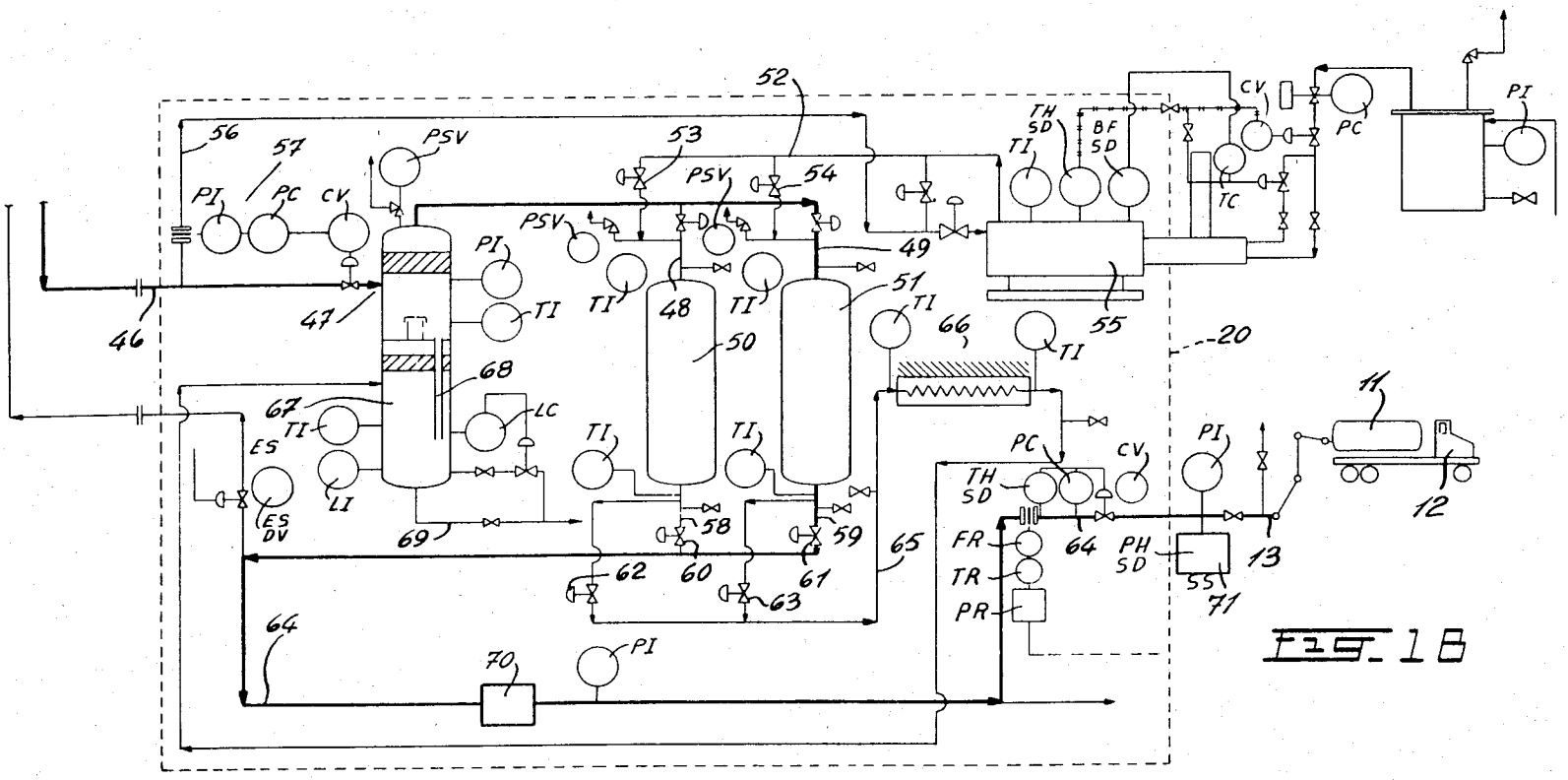
Figure 1C:
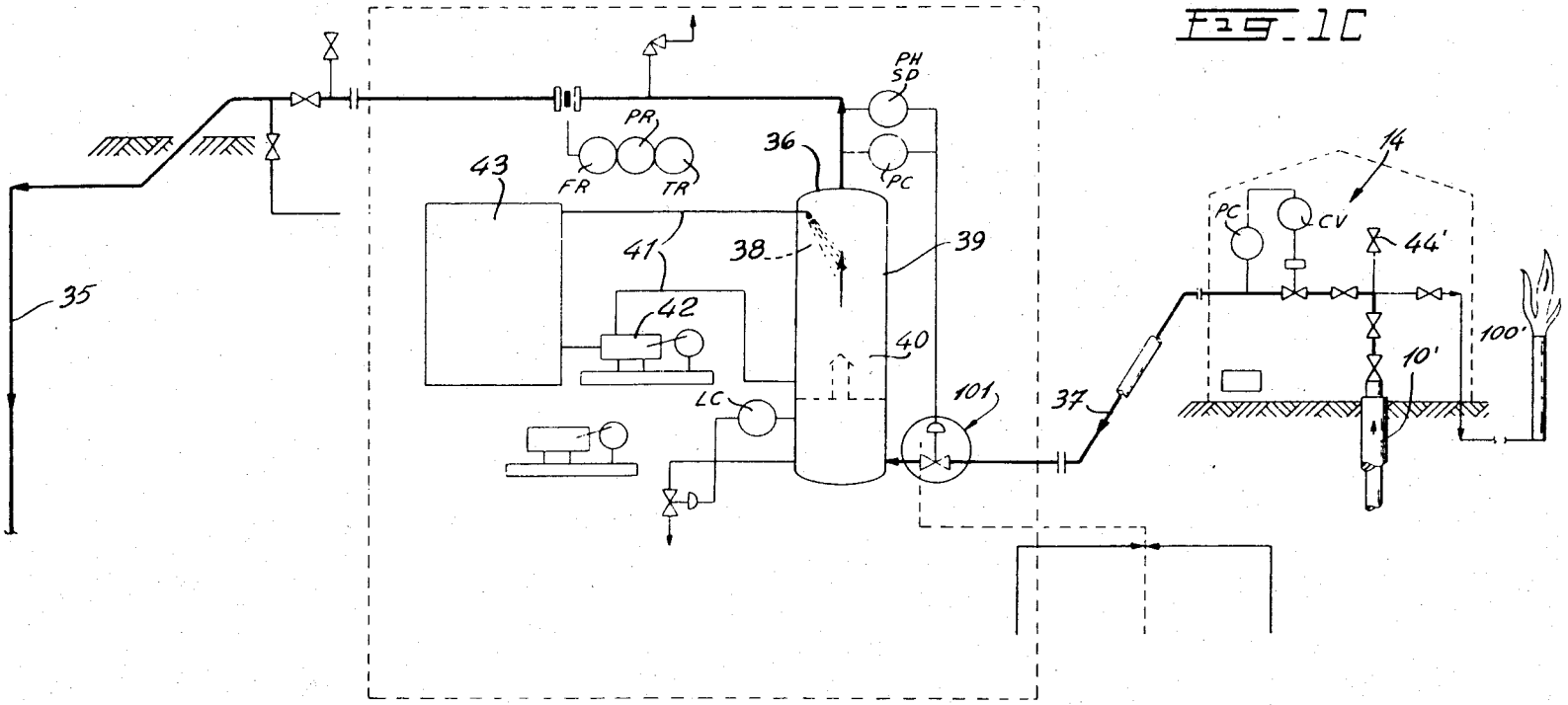

Referring now to the drawings, and more particularly to FIG. 1, there is shown the system of the present invention for treating natural gas from a gas well, herein gas wells 10 and 10', for loading into pressurized vessels 11 mounted on road vehicles 12. The gas at the loading terminal end 13 should be at a pressure in excess of 2000 psi when loading is completed.

Generally, the loading apparatus comprises piping and valve means 14 at each well head 10 and 10' for taking the gas from the well and feeding it along a pipe line 15 to a compressor stage 16 where the gas is compressed to 2400 psig although the compressor is designed to operate to compress the gas at higher pressures up to 3000 psig. The inlet of the compressor stage 16 comprises a heat exchanger 17 through which the gas in the pipe line 15 is first fed to warm up the gas to a temperature sufficient to prevent the formation of hydrates for safe operation of the pressure control valve 18 which regulates the gas pressure at the inlet end of the compressor 19 to ensure constant gas flow through the compressor and a dehydrator stage 20 connected at the output of the compressor stage 16.

The gas at the outlet of the pressure control valve 18 is fed to an inlet separator 21 to remove any liquid which may be present in the gas whereby to provide a substantial liquid-free gas at the inlet end of the compressor. The compressor 19 is provided with a suction bottle 22 at an inlet 23 thereof and a discharge bottle 24 at the outlet 25 thereof to assure adequate volume of gas at the inlet 23 and to dampen pulsations from the compressor at the outlet 25. A motor 26 provides the drive for the compressor 19. As previously stated, the compressor raises the pressure of the gas to 2400 psig which is the transportation pressure of the vehicles 12. The warm gas at the output of the compressor is then fed to a cooler 27 to further reduce the volume of gas and to recondition the gas for dehydration. A fan 28 provides cooling of the gas in the radiator housing 29 with ambient air.

The gas at the outlet 30 of the cooler is then fed to the heat exchanger 17 where it is used to warm the incoming gas in the pipe line 15 connected to the well head. The outlet of the heat exchanger 17 is herein shown as being connected to a further heat exchanger 31 which is provided to warm up natural gas from a further well head 10' which is located remotely from the first well head 10. Of course, all of the well heads could be connected to a common pipe line at the inlet of a single heat exchanger.

The heat exchangers 17 and 31 are gas/gas exchangers and are provided to heat cold inlet gas with hot high-pressure gas discharged from the compressor. The heating of the water with inlet gas prevents hydrate formation in the inlet piping and control valves and also prevents hydrate formation in the co-mingled inlet gas stream. Cooling of the discharge gas from 110° F. will maximize free water drop out in the scrubber 32 which is provided in the pipe line from the outlet 30 of the cooler 27 to the inlets 33 and 33' of the heat exchangers 17 and 31, respectively. This arrangement reduces the dehydration load on the dehydrators, which will be described later, in the dehydrator stage 20.

The gas from the pipe line of the well head 10' passing through the heat exchanger 31 is also controlled by the pressure control valve 101. A valve 34 provides for the uni-directional flow of the gas from the well head 10' into the compressor stage 16. In order to provide for the safe transportation of the gas from the well head 10' to the compressor stage 16 via the pipe line 35, which pipe line may be a mile long, a glycol dehydrator 36 is provided in close proximity to the well head 10'. The dehydrator 36 removes and all impurities in the gas fed thereto from the pipe line 37 which is connected to the well head 10'. The glycol spray 38 is provided in the top part of the dehydrator column 39 and extracts water vapor from the gas flowing upwardly in the column. The glycol is collected at the bottom of an uppermost chamber 40 and recirculated through the loop line 41, via a circulation pump 42, back to the spray nozzle. The glycol is regenerated by suitable known apparatus 43 provided in the loop line 41.

It can also be seen that at each of the well heads 10 and 1O', there is provided an injection valve 44 and 44' whereby to inject methanol into the gas leaving the well head. This is done for hydrate prevention.

The dehydrator stage 20 substantially lowers the water vapor content in the gas to a concentration of less than 0.1 lb of $H_2O$/mmscf of gas whereby to prevent the formation of free water within the pressure vessels 11 of the road vehicle 12. In the herein described embodiment, the system provides for a concentration of less than 0.1 lb of $H_2O$/mmscf of gas. The cool gas exiting from the outlet 45 or 45' of the heat exchanger 17 or 31, respectively, is fed to the inlet 46 of the dehydrator stage 20. A further separator 47 which is connected to the inlet end 48 and 49 of two silica gel dessicant dehydrator towers 50 and 51. Any water still contained in the gas will be absorbed as it passes through the dessicant column in one of the dehydrator towers 50 and 51 The purpose of providing two dehydrators is to operate on a two-cycle basis whereby as one tower is utilized to absorb water from the gas, as the other tower is being regenerated. Thus, it is not necessary to shut down the system to permit the regeneration of the dessicant column.

In order to regenerate one of the towers, a regeneration gas line 52 is connected to a respective one of the inlets 48 and 49 via suitable valves 53 and 54, respectively, which are automatically operated by a timer device which operates the time cycle of the towers. A regenerating gas heater 55 is provided to heat a constant supply of gas which is tapped from gas line 56 at the inlet 46 of the dehydrator stage. Suitable valve means 57 controls the pressure and supply of gas to the regeneration gas heater 55.

The dehydration gas flows downwardly through the towers from the inlets 48 and 49 to their respective outlets 58 and 59. The valves 60 and 61 and 62 and 63 at the outlets of the towers 50 and 51 are automatically controlled to connect one outlet to the outlet gas feed line 64 and the other to a feedback line 65 for the regeneration gas flow. The regenerating gas feedback line 65 is connected to a gas cooler 66 to cool the hot regeneration gas which has extracted moisture from the dessicant bed and feeds back the cool gas into a bottom compartment 67 of the separator 47 where the gas will flow upwardly through the conduit 68 and to the upper chamber to further separate water from the gas and the liquid in the gas will be retained in the bottom compartment 67 where it is drained off via the outlet line 69.

A ceramic-type filter unit 70 is connected in the outlet gas feed line 64 to remove any fine solid particle that may be present in the gas after its passage through the dessicant bed in the dehydrator towers 50 and 51. A pressure switch 71 is also connected in the feed line 64 downstream of the compressor to provide a signal to stop the compressor when the pressure gas being loaded in the vessels reaches a predetermined value.

The loading facility at the terminal end 13 is not described herein but it is pointed out that it is designed to remotely start the plant from a tank truck parking area. The start up will only occur when a proper key is inserted in a switch, the vehicle 12 grounded and all functions operational at the plant. A flare stack 100, 100' is also provided to burn off any combustible products which are removed from the separator outlets such as outlet 21' of separator 21 and the outlets of various emergency shut-down valves provided in the pipe line throughout the system. Such emergency shut down valves are herein coded as ESD valves. Various other valves and controls shown in the drawings but not described herein are coded whereby their functions become obvious to a person skilled in the art. The legend of these components is described in Table I hereinbelow.

TABLE I

| Legend: | |
|---|---|
| ESD | Emergency Shut-Down |
| PLSD | Low Pressure Shut-Down |
| PSV | Pressure Relief Valve |
| PC | Pressure Control |
| LC | Level Control |
| TC | Temperature Control |
| TR | Temperature Recorder |
| PR | Pressure Recorder |
| FR | Flow Recorder |
| VHSD | High Vibration Shut-Down |
| PHSD | High Pressure Shut-Down |
| FRC | Flow Recorder Controller |
| THSD | High Temperature Shut-Down |
| DPS | Differential Pressure Switch |

The control system utilized is designed to operate in a fail-safe manner in that all field contacts are normally closed while running and open under alarm conditions, this eliminates failure to shut down in the event of broken signal conductors or faults in relays utilized. The control system is based upon three shutdown levels, emergency, equipment failure, and power failure.

Figure 2:
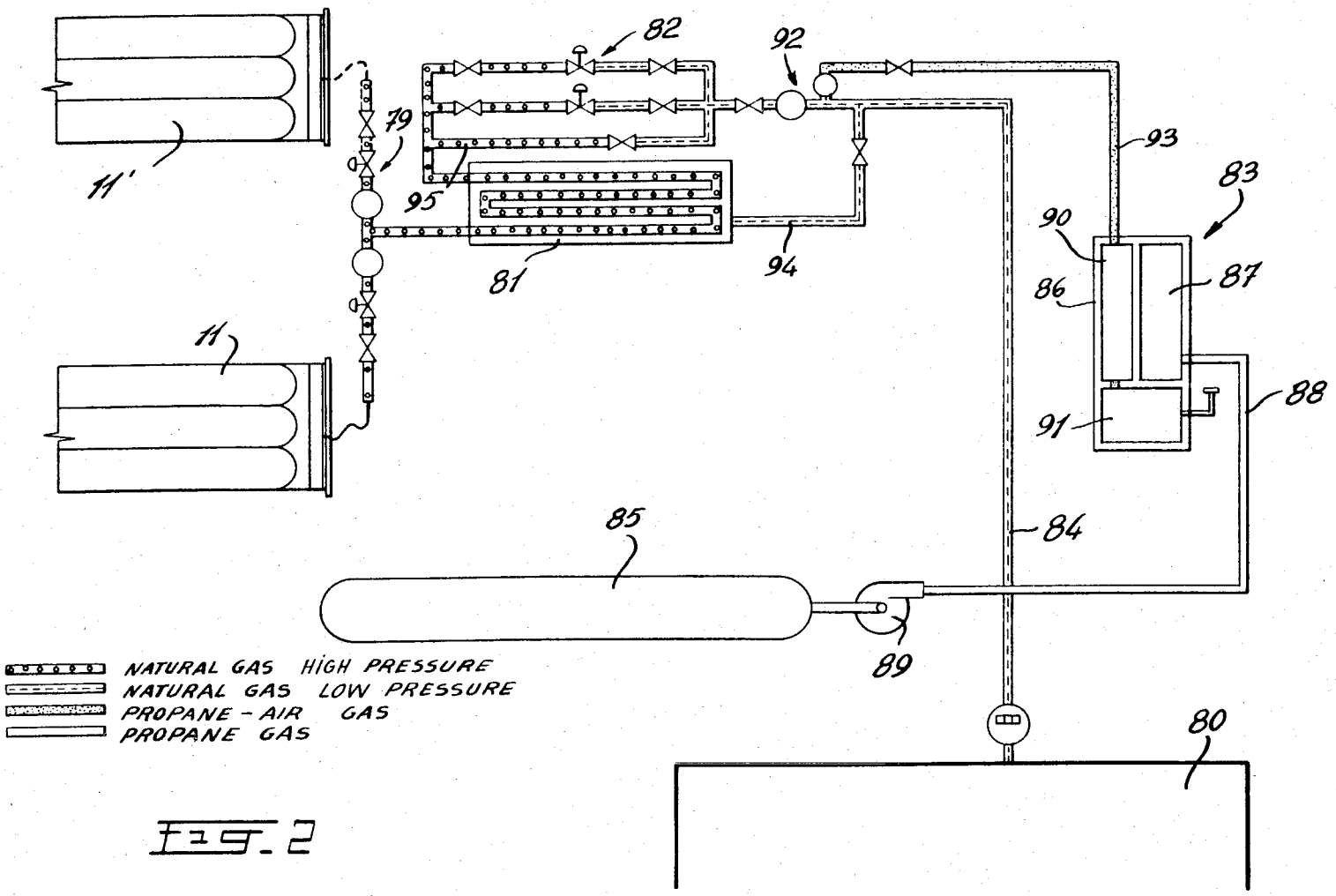
FIG. 2 is a simplified schematic flow diagram of the unloading station of the system of the present invention.

Referring now to FIG. 2, there is schematically illustrated the improvement at an unloading station whereby a constant supply of pressurized gas can be fed to a user 80. As illustrated the pressure vessels 11 are connected to suitable unloading means 79 comprised of pipes and automatic control flow valves for the safe discharge of pressurized natural gas from the pressure reservoir 11. The gas flows to a heater 81 where the discharged gas is heated to prevent reaching embrittlement temperature of the steel. Pressure regulating valves 82 maintain the discharged gas at a pressure at between 20 to 28 psig. The improvement at the unloading station comprises the provision of a stand-by gas supply system 83 for feeding gas to the user 80 when a predetermined pressure drop occurs in the main feed conduit 84 due to an insufficient supply of gas remaining in the vessel 11. As herein shown there are two vessels 11 and 11' and usually only one is connected, herein vessel 11. In operation vessel 11' would arrive at the unloading station before vessel 11 is emptied whereby to ensure that there is a continuous supply of compressed natural gas. However, should for any reason the road vehicle not arrive on time, the user must be supplied from another source.

The stand-by gas supply system 83 comprises a propane gas reservoir 85 feeding an air/gas mixer device 86. The mixer device 86 includes a propane vaporizing chamber 87 to which a supply conduit 88 is connected from the reservoir 85 whereby propane gas is pumped thereto by pump 89. Propane vaporizes in the chamber 87 and the vapor is fed to a mixing chamber 90. The device 86 further comprises a compressed air chamber 91 which is in communication with the mixing chamber 90 where compressed air mixes with the vaporized propane gas to continue feeding the conduit 84 with a high pressure propane gas. The switch 92 is automatically operated to shut off the supply from the pressurized reservoir 11 and to connect the propane gas conduit 93 to conduit 84. Check valves 92 and 92' prevent back flow of natural gas in the air/propane system and vice versa. The feed back line 94 at the outlet of the pressure regulating valves provides the necessary fuel gas for burners in the heater device 81. By-pass conduit 95 is normally closed in normal operations of the system.

It is within the ambit of the present invention to cover any obvious modifications of the embodiment described herein, provided such modifications fall within the scope of the appended claims.

The embodiments of the invention in which an exclusive property or privilege is claimed are defined as follows:

1. A system for treating natural gas from a gas source to make it suitable for safe transport in high tensile strength steel pressure vessels at pressures in excess of 2000 psi, said system comprising means for taking gas from a gas source, a separator for removing free liquids from gas fed thereto from said gas source to provide a substantially liquid-free gas, a compressor for compressing said substantially liquid-free gas to a higher pressure to reduce the volume of said gas for storage in said pressure vessels, a cooler to further reduce said volume of gas and to recondition the gas for dehydration, a dehydrator to substantially lower the water vapor content in the said gas to a concentration of less than 0.1 lb $H_2O$/mmscf of gas to prevent the formation of free water within said pressure vessels when transporting and unloading said gas which water could cause internal corrosion and failure of said pressure vessels, loading means to load the pressurized dehydrated gas in said vessels, a heat exchanger connected between said gas source and said compressor to warm up said gas from said gas source to a temperature sufficient to prevent the formation of hydrates for safe operation of a pressure control valve which regulates the gas pressure at an inlet of said compressor to assure constant gas flow through said compressor and said dehydrator having two dessicant towers operating on a two cycle basis whereby one of said towers is regenerated while the other tower is operational, a regeneration gas line at an inlet of each tower, control valve means in said gas line to feed heated regeneration gas from a regeneration gas heater to said regenerating tower during a predetermined time to dry a dessicant in said tower, said regeneration gas heater being implemented with gas from said outlet of said heat exchanger.

2. A system as claimed in claim 1 wherein said heat exchanger is a gas/gas exchanger to heat said gas from said gas source with hot high pressure gas discharged from said compressor.

3. A system as claimed in claim 2 wherein said heat exchanger further cools said gas discharged from said compressor to further condition said gas for dehydration, said cooler being connected between said compressor and said heat exchanger.

4. A system as claimed in claim 3 wherein there is provided a further heat exchanger connected in series with said first heat exchanger, said further heat exchanger providing further cooling of said gas discharged from said compressor prior to feeding same to said dehydrator.

5. A system as claimed in claim 4 wherein said further heat exchanger is connected to a further gas source at a remote location, a glycol dehydrator connected to an outlet of said source at said remote location, said glycol dehydrator removing water and oil impurities in said gas, a glycol spray in said dehydrator to extract water vapor from said gas, said glycol being recirculated in an uppermost chamber of said dehydrator.

6. A system as claimed in claim 5 wherein said gas sources are gas wells, valve means at each said gas wells for injection of an alcohol in said gas to prevent the formation of hydrates in said gas.

7. A system as claimed in claim 1 wherein a further separator is connected between an outlet of said heat exchanger and an inlet of said dehydrator to remove any water that may have condensated in said gas during passage through said heat exchanger.

8. A system as claimed in claim 1 wherein a time sequence controller is provided to control valve means at said inlet and an outlet of said towers to connect said dried high pressure gas at the outlet of said operational tower to said loading means, the outlet of said regenerating tower being connected to a regeneration gas cooler which is connected to a further separator connected between an outlet of said heat exchanger and said inlet of said operational tower to remove water from said gas passing through said regenerating tower.

9. A system as claimed in claim 1 wherein said compressor is provided with a suction bottle at an inlet thereof and a discharge bottle at an outlet thereof to assure adequate volume of gas at the inlet and dampen pulsations from the compressor at the outlet.

10. A system as claimed in claim 1 wherein an oil scrubber is connected between said compressor and said heat exchanger to remove oil and water that may be present in said compressed gas prior to feeding said gas to said dehydrator.

11. A system as claimed in claim 1 wherein a filter is connected between an outlet of said dehydrator and said loading means to remove any fine solid particles that may have been released in said gas during its passage through a dessicant bed in said dehydrator.

12. A system as claimed in claim 1 wherein there is further provided pressure regulating valve means to assure proper gas pressure, flare conduit means to evacuate gas from said system through a flare stack having an automatically operable flare ignition system, an emergency valve control system to evacuate said system under alarm conditions, and a drain system for discharging water and oil extracted from said gas.

13. A system as claimed in claim 1 wherein said concentration of said water vapor content in said gas is less than 0.1 lb $H_2O$/mmscf.

14. A system for treating natural gas from a gas source to make it suitable for safe transport in pressure vessels at pressures in excess of 2000 psi, and for feeding a constant supply of pressurized gas to a gas user, said system comprising means for taking gas from a gas source, a separator for removing free liquids from gas fed thereto from said gas source to provide a substantially liquid-free gas, a compressor for compressing said substantially liquid-free gas to a higher pressure to reduce the volume of said gas for storage in said pressure vessels, a cooler to further reduce said volume gas and to recondition the gas for dehydration, a dehydrator to substantially lower the water vapor content in the said gas to a concentration of less than 0.5 lb $H_2O$/mmscf to prevent the formation of free water within said pressure vessels when transporting and unloading said gas which water would cause internal corrosion and failure of said pressure vessels, loading means to load the pressurized dehydrated gas in said vessels, unloading means to unload said pressurized dehydrated gas from said pressure vessels, a heater for heating discharged gas from said vessels to maintain said gas at a temperature above the embrittlement temperature of steel, pressure regulating means to maintain said discharged gas at a constant line pressure in excess of 18 psi, and a stand-by gas supply system for feeding a propane/air mixture to said user when the natural gas system alone cannot maintain an adequate energy supply to said user.

15. A system as claimed in claim 14 wherein said stand-by gas supply system comprises a propane gas reservoir, an air/gas mixer having a propane vaporizing chamber and a compressed air chamber, both said chambers being in communication with a mixing chamber where a constant supply of compressed gas/air is provided to feed said user.

16. A system for treating natural gas from a gas source to make it suitable for safe transport in high tensile strength steel pressure vessels at pressures in excess of 2000 psi, said system comprising means for taking gas from a gas source, a separator for removing free liquids from gas fed thereto from said gas source to provide a substantially liquid-free gas, a compressor for compressing said substantially liquid-free gas to a higher pressure to reduce the volume of said gas for storage in said pressure vessels, a cooler to further reduce said volume of gas and to recondition the gas for dehydration, a dehydrator to substantially lower the water vapor content in the said gas to a concentration of less than 0.1 lb $H_2O$/mmscf of gas to prevent the formation of free water within said pressure vessels when transporting and unloading said gas which water could cause internal corrosion and failure of said pressure vessels, loading means to load the pressurized dehydrated gas in said vessels, a heat exchanger connected between said gas source and said compressor to warm up said gas from said gas source to a temperature sufficient to prevent the formation of hydrates for safe operation of a pressure control valve which regulates the gas pressure at an inlet of said compressor to assure constant gas flow through said compressor and said dehydrator, said heat exchanger being a gas/gas exchanger to heat said gas from said gas source with hot high pressure gas discharged from said compressor, said heat exchanger further cooling said gas discharged from said compressor to further condition said gas for dehydration, said cooler being connected between said compressor and said heat exchanger, a further heat exchanger connected in series with said first heat exchanger, said further heat exchanger providing further cooling of said gas discharged from said compressor prior to feeding same to said dehydrator, said further heat exchanger being connected to a further gas source at a remote location, a glycol dehydrator connected to an outlet of said source at said remote location, said glycol dehydrator removing water and oil impurities in said gas, a glycol spray in said dehydrator to extract water vapor from said gas, said glycol being recirculated in an uppermost chamber of said dehydrator.

17. A system for treating natural gas from a gas source to make it suitable for safe transport in high tensile strength steel pressure vessels at pressures in excess of 2000 psi, said system comprising means for taking gas from a gas source, a separator for removing free liquids from gas fed thereto from said gas source to provide a substantially liquid-free gas, a compressor for compressing said substantially liquid-free gas to a higher pressure to reduce the volume of said gas for storage in said pressure vessels, a cooler to further reduce said volume of gas and to recondition the gas for dehydration, a dehydrator to substantially lower the water vapor content in the said gas to a concentration of less than 0.1 lb $H_2O$/mmscf or gas to prevent the formation of free water within said pressure vessels when transporting and unloading said gas which water could cause internal corrosion and failure of said pressure vessels, loading means to load the pressurized dehydrated gas in said vessels, a heat exchanger connected between said gas source and said compressor to warm up said gas from said gas source to a temperature sufficient to prevent the formation of hydrates for safe operation of a pressure control valve which regulates the gas pressure at an inlet of said compressor to assure constant gas flow through said compressor and said dehydrator, pressure regulating valve means is provided to assure proper gas pressure, flare conduit means to evacuate gas from said system through a flare stack having an automatically operable flare ignition system, an emergency valve control system to evacuate said system under alarm conditons, and a drain system for discharging water and oil extracted from said gas.

* * * * *